United States Patent [19]

Hanekamp

[11] Patent Number: 5,074,460

[45] Date of Patent: Dec. 24, 1991

[54] CONTAINER STRUCTURE

[76] Inventor: Matthew R. Hanekamp, 929 E. Washington St., Louisville, Ky. 40206

[21] Appl. No.: 602,623

[22] Filed: Oct. 24, 1990

[51] Int. Cl.[5] ..... B65D 5/10

[52] U.S. Cl. ..... 229/117; 229/117.05; 229/117.15

[58] Field of Search ..... 229/117, 117.01, 117.05, 229/117.15, 117.16; 206/434; 220/462, 463, 416

[56] References Cited

U.S. PATENT DOCUMENTS

| | | | |
|---|---|---|---|
| 2,155,636 | 4/1939 | Bensel | 229/117.01 |
| 2,898,029 | 8/1959 | Sherman | 229/117.01 |
| 3,501,081 | 3/1970 | Paige | 229/117 |
| 3,861,581 | 1/1975 | Sellors | 229/117 |
| 3,899,124 | 8/1975 | Desmond et al. | 229/117 |
| 4,093,114 | 6/1978 | Lawes | 220/462 |
| 4,120,420 | 10/1978 | Dirksing | 220/462 |
| 4,129,248 | 12/1978 | Casutt | 229/117.05 |
| 4,428,500 | 1/1984 | Kohler | 220/462 |
| 4,678,079 | 7/1987 | Henning | 229/117.14 |

FOREIGN PATENT DOCUMENTS

| | | | |
|---|---|---|---|
| 0429957 | 6/1935 | United Kingdom | 229/117.15 |

*Primary Examiner*—Stephen Marcus
*Assistant Examiner*—Christopher McDonald
*Attorney, Agent, or Firm*—Jon C. Winger

[57] ABSTRACT

A generally rectangular container fabricated of, for example, a heavy paper material such as pressed paperboard or corrugated cardboard, includes an inner, flexible moisture impermeable bag. The container is constructed so that the side walls, end walls, bottom wall and top wall are foldable to form a thin, flat stack having a rectangular perimeter when not in use for easy storage, and which can be formed into a strong container without the use of fasteners or adhesives.

10 Claims, 4 Drawing Sheets

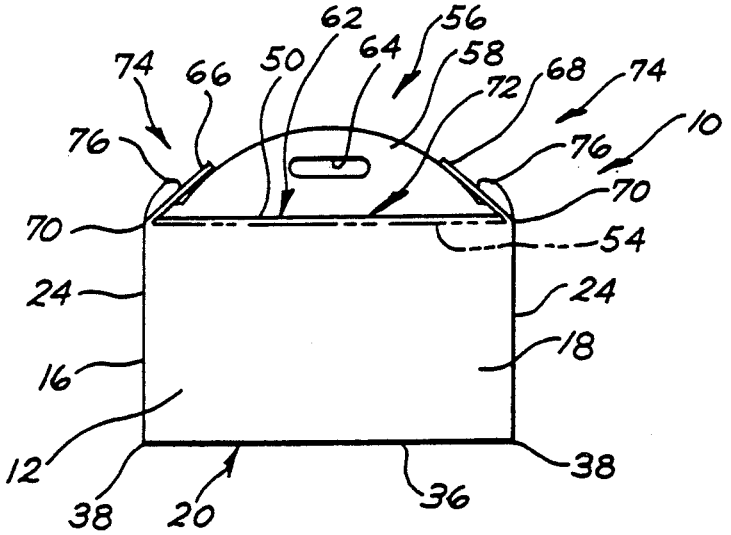
FIG. 1
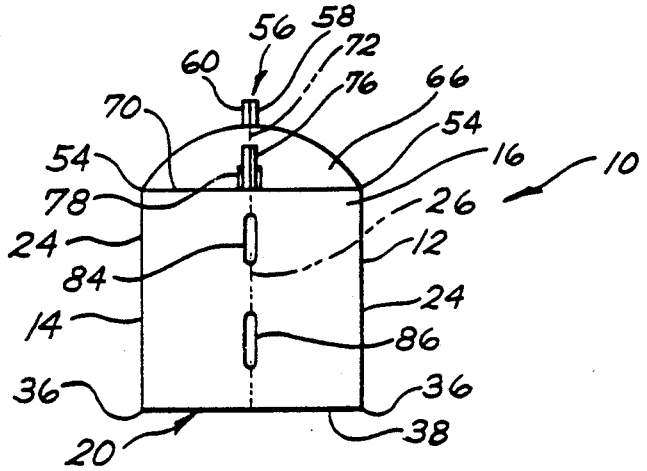
FIG. 2
FIG. 3
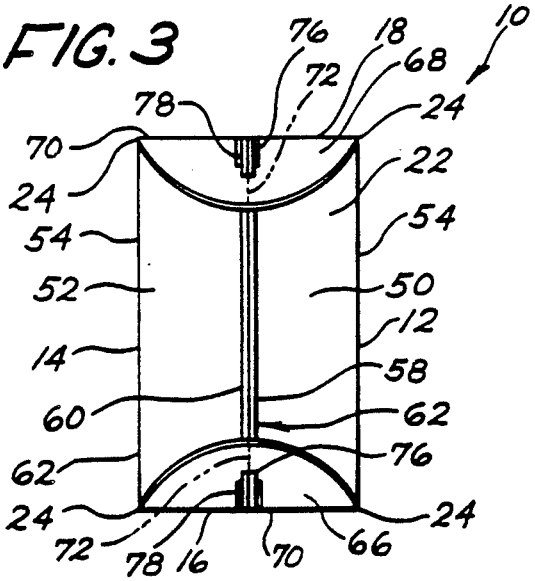
FIG. 4
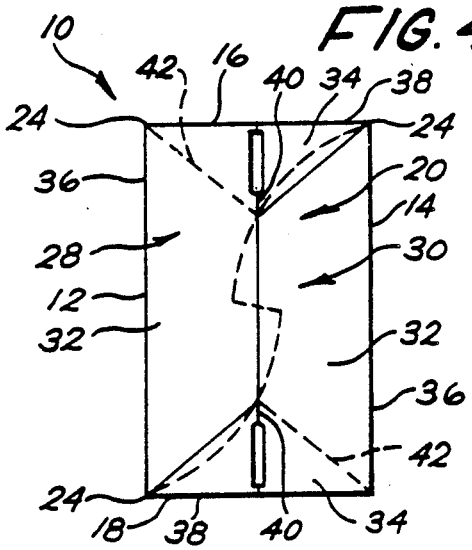

FIG. 7
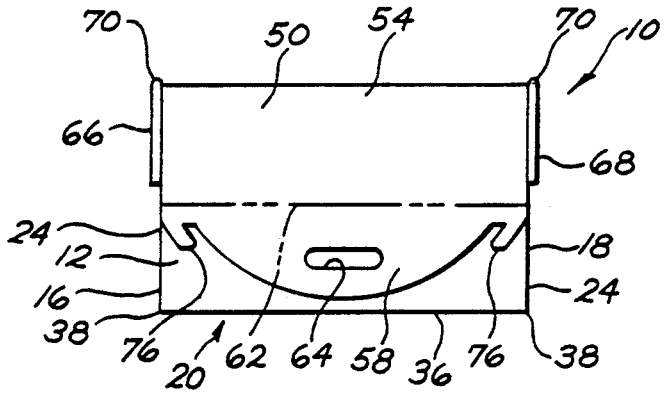
FIG. 9
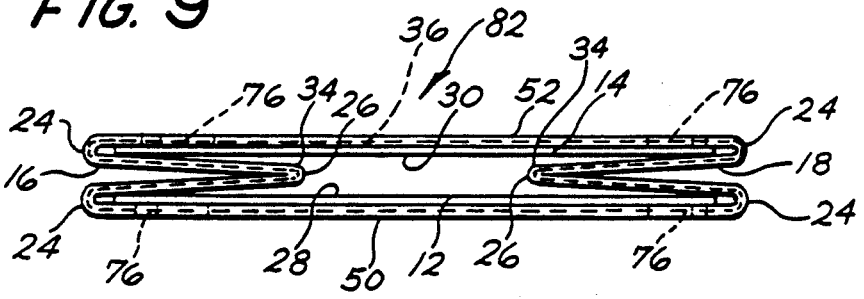
FIG. 10
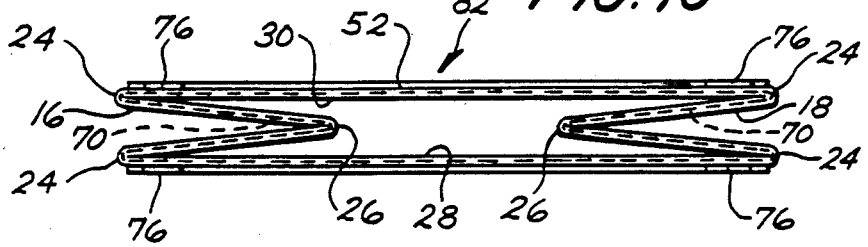
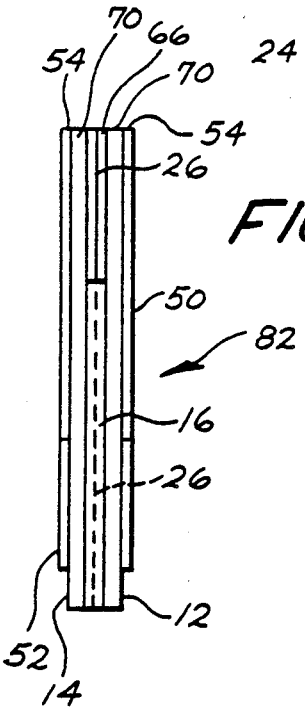
FIG. 11
FIG. 12
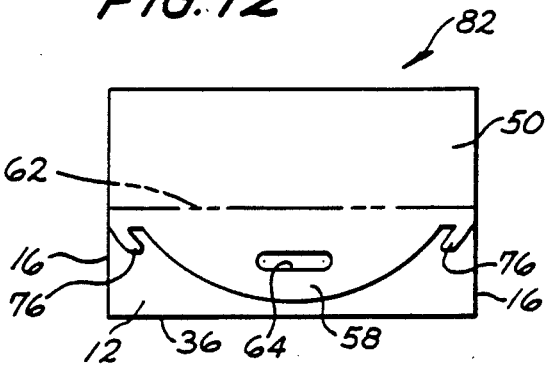

CONTAINER STRUCTURE

BACKGROUND OF THE INVENTION

1. Field of the Invention

The present invention relates to containers, and more particularly to a foldable container for carrying heavy articles which forms a thin stack of rectangular perimeter shape when folded for storage and which forms a rectangular or parallelpiped container when unfolded for use.

2. Description of the Prior Art

Containers fabricated of paperboard and cardboard materials for carrying articles are, per se, known. Examples of such prior art containers are shown in the following United States Patents: U.S. Pat. No. 2,078,455 issued on Apr. 27, 1937 to W. H. Peters; U.S. Pat. No. 2,202,153 issued on May 28, 1940 to K. B. Jones; U.S. Pat. No. 2,336,655 issued on Dec. 14, 1943 to L. H. Tobey et al; U.S. Pat. No. 2,565,939 issued on Aug. 28, 1951 to R. T. Wriston; U.S. Pat. No. 2,663,485 issued on Dec. 22, 1953 to R. H. Johnson; U.S. Pat. No. 2,838,222 issued on June 10, 1958 to C. J. Papadopoulos; U.S. Pat. No. 2,959,337 issued on Nov. 8, 1960 to W. B. Crane, Jr.; U.S. Pat. No. 3,112,057 issued on Nov. 26, 1963 to S. Lipschutz; U.S. Pat. No. 3,215,330 issued on Nov. 2, 1965 to J. W. Thomas; U.S. Pat. No. 3,339,820 issued on Sept. 5, 1967 to R. A. Krzyzanowski; and U.S. Pat. No. 3,591,070 issued on July 6, 1971 to George Vrana.

SUMMARY OF THE INVENTION

It is an objective to provide a container which is foldable to a stored position forming a thin stack of generally rectangular perimeter shape, and unfoldable to an in-use position forming a parallelpiped container having structural integrity without using fasteners or adhesives to maintain its structural integrity.

It is a further objective of the present invention to provide a container of the class described which includes a flexible, moisture impermeable bag.

More particularly, the present invention provides a container having side walls, end walls joined by fold lines to the side walls, and each of the end walls having an intermediate fold line about which each end wall is foldable in sections back over each other such that the end walls can be folded to overlay the inside surface of the side walls, a bottom wall formed by bottom flaps which are joined to the bottom edges of the side walls and end walls by fold lines such that the bottom flaps can be folded over the inside surface of the side walls and end walls, a top wall formed by top flaps which are joined to the top edges of the side walls such that the top flaps can be folded over the outside surface of the side walls, locking flaps which are joined to the top edges of the end walls by fold lines such that the locking flaps can be folded over the outside surface of the end walls.

BRIEF DESCRIPTION OF THE DRAWINGS

A better understanding of the present invention will be had upon reference to the following description in conjunction with the accompanying drawings wherein like numerals refer to like parts throughout the several views and in which:

FIG. 1 is a side elevation view of the container of the present invention;

FIG. 2 is an end elevation view of the container;

FIG. 3 is a top view of the container;

FIG. 4 is a bottom view of the container;

FIG. 7 is a side view of the container in a partially collapsed position;

FIG. 9 is a bottom view of the container in a collapsed position;

FIG. 10 is a top view of the container in a collapsed position;

FIG. 11 is an end view of the container in a collapsed position;

FIG. 12 is a side view of the container in a collapsed position;

DETAILED DESCRIPTIOIN OF THE PREFERRED EMBODIMENT

Figure 5:
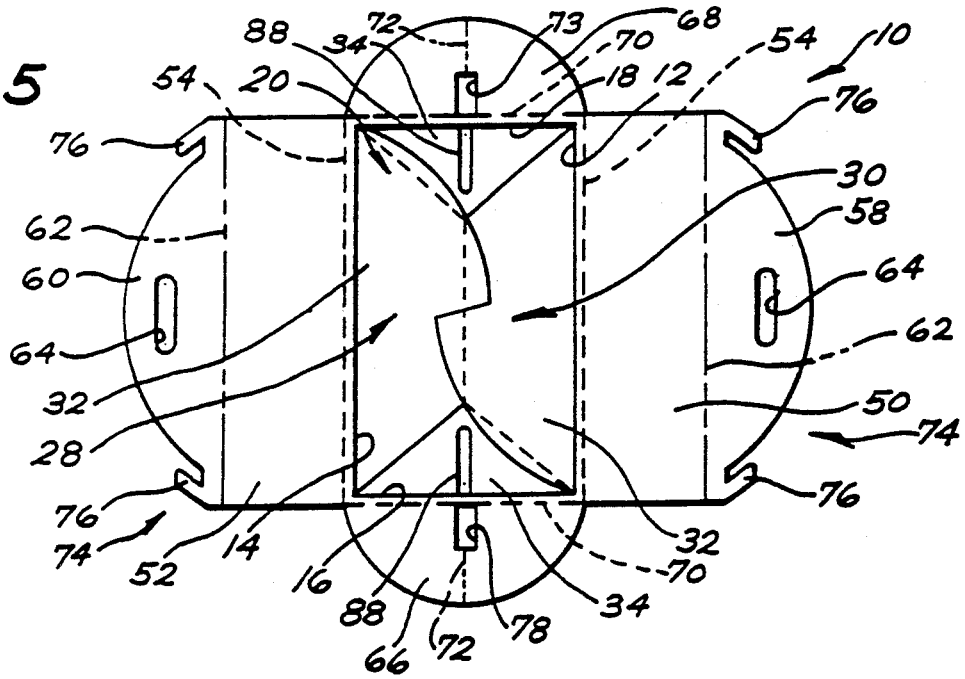
FIG. 5 is a top view of the container showing the top flaps and lock flaps folded to expose the top opening into the container.
Figure 6:
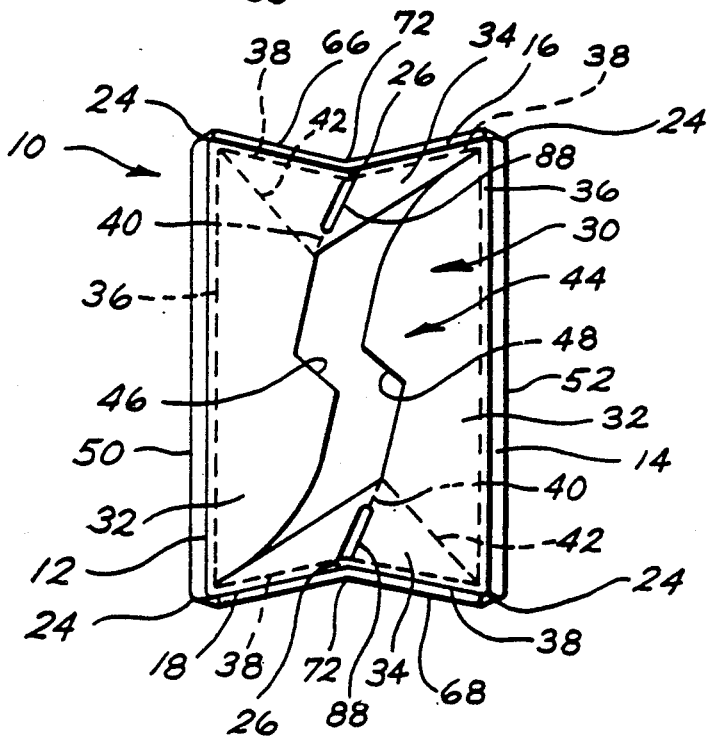
FIG. 6 is a bottom view of the container in a partially collapsed position.
Figure 8:
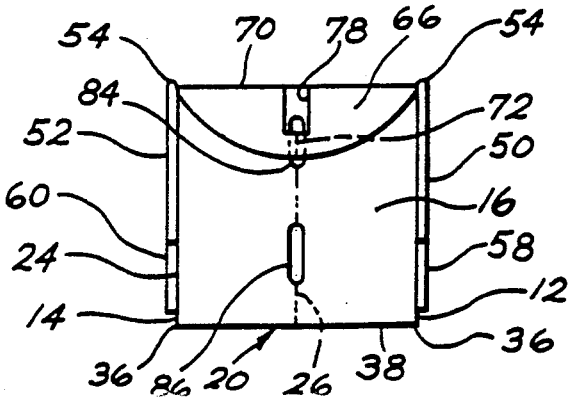
FIG. 8 is an end view of the container in a partially collapsed position.

As can be best seen in FIGS. 1–5, there is shown a container, generally denoted as the numeral 10, of the present invention. The container 10 comprises first and second side walls 12 and 14, first and second end walls 16 and 18, a bottom wall 20, and a top wall 22.

The first and second end walls 16 and 18 are joined at their opposite end edges to the end edges of the side walls 12 and 14. The junctions of the end walls 16 and 18 and side walls 12 and 14 define first fold lines 24 about which the end walls 16 and 18 are foldable relative to the side walls 12 and 14.

The first end wall 16 is formed with a second fold line 26 midway between and parallel to the first fold lines 24 defined by the juncture of the first end wall 16 and the first and second side walls 12 and 14 about which the sections of the first end wall 16 divided by the second fold line 26 can be folded back over each other. Similarly, the second end wall 18 is formed with a second fold line 26 midway between and parallel to the first fold lines 24 defined by the juncture of the second end wall 18 and the first and second side walls 12 and 14 about which the sections of the second wall 18 divided by the second fold line 26 can be folded back over each other.

The bottom wall 20 is comprised of first and second bottom flaps 28 and 30, respectively, which congruently cooperate to form the bottom wall 20 closing the bottom of the container 10. The first bottom flap 28 has a first portion 32 joined to the bottom edge of the first side wall 12 and a second portion 34 joined to the bottom edge of the first end wall 16. The juncture of the first portion 32 of the first bottom flap 28 and the first side wall 12 defines a third fold line 36 about which the first portion 32 of the first bottom flap 28 is foldable relative to the first side wall 12. The juncture of the second portion 34 of the first bottom flap 28 and the first end wall 16 defines a fourth fold line 38 about which the second portion 34 of the first bottom flap 28 is foldable relative to the first end wall 16. Similarly, the second bottom flap 30 has a first portion 32 joined to the bottom edge of the second side wall 14 and a second portion 34 joined to the bottom edge of the second end wall 18.

The juncture of the first portion 32 of the second bottom flap 30 and the second side wall 14 defines a third fold line 36 about which the first portion 32 of the second bottom flap 30 is foldable relative to the second side wall 14. The juncture of the second portion 34 of the second bottom flap 30 and the second end wall 18 defines a fourth fold line 38 about which the second portion 34 of the second bottom flap 30 is foldable relative to the second end wall 18. The second portion 34 of the first bottom flap 28 is formed with a fifth fold line 40 in alignment with the second fold line 26 in the first end wall 16 about which the sections of the second portion 34 of the first bottom flap 28 divided by the fifth fold line 40 can be folded back over each other, and the second portion 34 of the second bottom flap 30 is formed with a fifth fold line 40 in alignment with the second fold line 26 in the second end wall 18 about which the sections of the second portion 34 of the second bottom flap 30 divided by the fifth fold line 40 can be folded back over each other. The first bottom flap 28 is formed with a sixth fold line 42 dividing the first and second portions 32 and 34 thereof and extending from the juncture of the first side wall 12 and first end wall 16 at the bottom edges of the first side wall 12 and first end wall 16 to the distal end of the fifth fold line 40 formed in the second portion 34 of the first bottom flap 28. The first and second portions 32 and 34 of the first bottom flap 28 are foldable relative to each other about the sixth fold line 42. Similarly, the second bottom flap 30 is formed with a sixth fold line 42 dividing the first and second portions 32 and 34 thereof and extending from the juncture of the second side wall 14 and second end wall 18 at the bottom edges of the second side wall 14 and second end wall 18 to the distal end of the fifth fold line 40 formed in the second portion 34 of the second bottom flap 30. The first and second portions 32 and 34 of the second bottom flap 30 are foldable relative to each other about the sixth fold line 42.

The first and second bottom flaps 28 and 30, respectively, include interlocking means 44 which lock the first and second flaps together in cooperative relationship forming the container bottom wall 20. As shown, the interlocking means 44 comprises a notch 46 formed in the free or distal edge of the first portion 32 of the first bottom flap 28 and a congruent notch 48 formed in the free or distal edge of the first portion 32 of the second bottom flap 30. The notch 46 and notch 48 interengage to releasably interlock the free edges of the first and second bottom flaps 28 and 30 together.

The top wall 22 is comprised of first and second flaps 50 and 52, respectively, which cooperate to form the top wall 22 closing the top of the container 10. The first top flap 50 is joined to the top edge of the first side wall 12. The juncture of the first flap 50 and the first side wall 12 defines a seventh fold line 54 about which the first top flap 50 is foldable relative to the first side wall 12. The second top flap 52 is joined to the top edge of the second side wall 14. The juncture of the second top flap 52 and the second side wall 14 defines a seventh fold line 54 about which the second top flap 52 is foldable relative to the second side wall 14.

The top wall 22 includes a handle 56. The handle 56 comprises first and second handle flaps 58 and 60, respectively, which cooperate in mutual overlaying relationship to form the handle 56 projecting from the container top wall 22. The first handle flap 58 is joined to the distal edge of the first top flap 50 with the juncture defining an eighth fold line 62 parallel to the top edge of the first side wall 12 about which the first handle flap 58 is foldable relative to the first top flap 50. The second handle flap 60 is joined to the distal edge of the second top flap 52 with the juncture defining an eighth fold line 62 parallel to the top edge of the second side wall 14 about which the second handle flap 60 is foldable relative to the second top flap 52. The first and second handle flaps 58 and 60 are each formed with an elongated aperture 64 which are in mutual registration when the first and second handle flaps 58 and 60 are in overlaying relationship so that the fingers of a human hand can be inserted therethrough for carrying the container 10.

The container 10 also includes first and second lock flaps 66 and 68, respectively, for locking the first and second top flaps 58 and 60 in position across the top opening of the container 10 forming the top wall 22. The first lock flap 66 is joined to the top edge of the first end wall 16 with the juncture forming a ninth fold line 70 about which the first lock flap 66 is foldable relative to the first end wall 16. The second lock flap 68 is joined to the top edge of the second end wall 18 with the juncture forming a ninth fold line 70 about which the second lock flap 68 is foldable relative to the second end wall 18. The first lock flap 66 is formed with a tenth fold line 72 in aligment with the second fold line 26 in the first end wall 16 about which the sections of the first lock flap 66 divided by the tenth fold line 72 can be folded back over each other. Similarly, the second lock flap 68 is formed with a tenth fold line 72 in alignment with the second fold line 26 in the second end wall 18 about which the sections of the second lock flap 68 divided by the tenth fold line 72 can be folded back over each other.

The first and second lock flaps 66 and 68 fold over the first and second top flaps 50 and 52 and are releasably interlocked to the first and second handle flaps 58 and 60 to hold the top flaps 50 and 52 in a closed position closing the top opening of the container. Toward this objective, interlocking means, generally denoted by the numeral 74, are provided. The interlocking means 74 is shown as comprising hooks 76 formed in the first handle flap 58 at opposite ends thereof, and identical hooks 76 formed in the second handle flap 60 at opposite ends thereof. A different one of the hooks 76 of the first handle flap 58 are in registration with different ones of the hooks 76 of the second handle flap 60 when the first and second handle flaps 58 and 60 are in mutual overlaying relationship forming the handle 56. The interlocking means 76 also includes a hook receiving slot 78 formed in each of the first and second lock flaps 66 and 68 for receiving the hooks 76 at the opposite ends of the handle 76 thereby interlocking the hook flaps 66 and 68 over the top flaps 50 and 52. The hook receiving slot 78 extends along the tenth fold line 72 of the lock flap 66, 68 from the ninth fold line 70 at the juncture of lock flap 66, 68 to the end wall 16, 18 a distance short of the free edge of the lock flap 66, 68.

Figure 13:
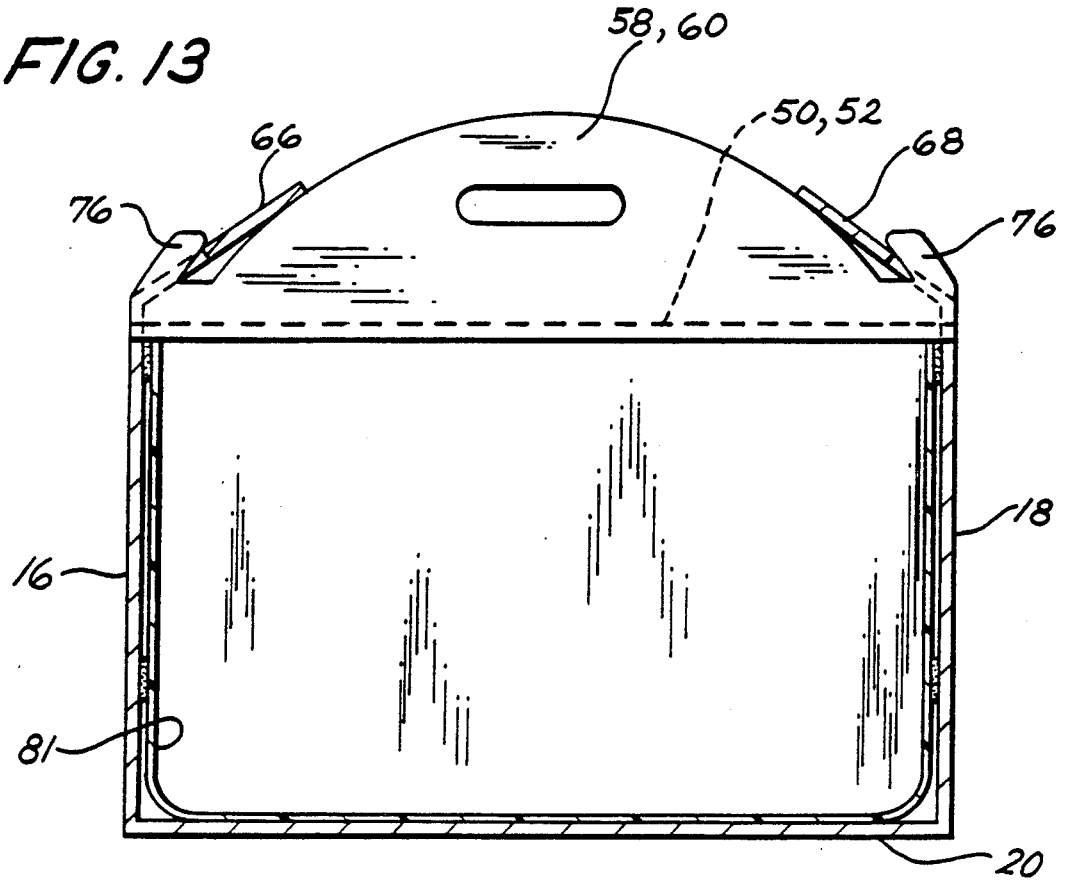
FIG. 13 is a cross-sectional side view of the container of FIG. 1 including a bag in its interior; and, FIG. 14 is an enclosure for receiving the collapsed container for compact storage.

As can be seen in FIG. 13, a flexible moisture impermeable bag 81 is positioned in the container 10 with the open top of the bag 81 coinciding with the open top of the container 10. The bag 81 can be secured in position by, for example, an adhesive fastening the bag 81 to, for example, the inside surface of the side walls 12 and 14.

With reference to FIGS. 6–12, in order to fold the container to form a flat stack 82 (FIGS. 9–12) having a rectangular perimeter, the first bottom flap 28 and second bottom flap 30 are moved upwardly into the interior of the container 10 causing the first portion 32 of the first bottom flap 28 to fold about its third fold line 36 into overlaying relationship to the inside surface of the first side wall 12 and the second portion 34 of the first bottom flap 28 to fold about its fourth fold line 38 and into overlaying relationship to the inside surface of the first end wall 16, and causing the first portion 32 of the second bottom flap 30 to fold about its third fold line 36 into overlaying relationship to the inside surface of the second side wall 14 and the second portion 34 of the second bottom flap 30 to fold about its fourth fold line 38 into overlaying relationship to the inside surface of the second end wall 18. Concurrently, the first and second end walls 16 and 18 are moved inwardly into the interior of the container 10 causing the sections of each of the end walls 16, 18 divided by the second fold line 26 to fold about the second fold line 26 back over each other and causing each of the end wall sections to fold about the first fold lines 24 into overlaying relationship to the inside surface of the first and second side walls 12 and 14. As the first and second end walls 16, 18 move inwardly of the container and the sections of the end walls 16, 18 fold about the second fold line 26, the first lock flap 66 is folded back over the exterior surface of the first end wall 16 and the second lock flap 68 is folded back over the exterior surface of the second end wall 18 such that the tenth fold line 72 of the lock flaps 66 and 68 overlays the second fold line 26 of the end walls 16 and 18. Thus, the sections of the lock flaps 66 and 68 divided by the tenth fold line 72 fold over about the tenth fold line 72 over each other as the sections of the end walls 16 and 18 are folded about the second fold line 26. The first top flap 50 is folded about the seventh fold line 54 into overlaying relationship to the exterior surface of the first side wall 12, and the second top flap 52 is folded about the seventh fold line 54 into overlaying relationship to the exterior surface of the second side wall 14. Then, the first handle flap 58 is folded about the eighth fold line 62 back over the exposed side of the folded first top flap 50 and the second handle flap 60 is folded about the eighth fold line 62 back over the exposed side of the folded second top flap 52. Thus, as can be seen in FIGS. 9–12, the container forms a relatively thin stack 82 having a generally rectangular perimeter corresponding to the perimeter of the first and second side walls.

As can be best seen in FIGS. 2, 5, 6, and 8, each end wall 16 and 18 is formed with a first slot 84 and a second slot 86 longitudinally spaced apart from each other and longitudinally aligned on the second fold line 26. In addition, the second portion 34 of the first bottom flap 28 is formed with a third slot 88 longitudinally aligned on the fifth fold line 40 and, therefore, longitudinally aligned with the first slot 84 and second slot 86 of the adjoining first end wall 16, and the second portion 34 of the second bottom flap 30 is formed with a third slot 88 longitudinally aligned on the fifth fold line 40 and, therefore, longitudinally aligned with the first slot 84 and second slot 86 of the adjoining second end wall 18. The third slot 88 in the second portion 34 of the first bottom flap 28 extends along the fifth fold line 40 from the fourth fold line 38 at the juncture of the second portion 34 of the first bottom flap 28 to the first end wall 16 a distance short of the free edge of the second portion 34 of the first bottom flap 28. The third slot 88 in the second portion 34 of the second bottom flap 30 extends along the fifth fold line 40 from the fifth fold line 38 at the juncture of the second portion 34 of the second bottom flap 30 to the second end wall 18 a distance short of the free edge of the second portion 34 of the second flap 30. The first slot 84 in the first end wall 16 is spaced from the ninth fold line 70 at the juncture of the first lock flap 66 to the top edge of the first end wall 16 by a distance less than the length of the hook receiving slot 78 in the first lock flap 66, and the length of the first slot 84 in the first end wall 16 is greater than the distance between the free edge of the first lock flap 66 and the adjacent end of the hook receiving slot 78 measured along the tenth fold line 72 in the first lock flap 66. The first slot 84 in the second end wall 18 is spaced from the ninth fold line 70 at the juncture of the second lock flap 68 to the top edge of the second end wall 18 by a distance less than the length of the hook receiving slot 78 in the second lock flap 68, and the length of the first slot 84 in the second end wall 18 is greater than the distance between the free edge of the second lock flap 68 and the adjacent end of the hook receiving slot 78 measured along the tenth fold line 72 in the second lock flap 68. The second slot 86 in the first end wall 16 is spaced from the fourth fold line 38 at the juncture of the first end wall 16 to the second portion 34 of the first bottom flap 28 by a distance less than the length of the third slot 88 in the second portion 34 of the first bottom flap 28, and the length of the second slot 86 in the first end wall 16 is greater than the distance between the free edge of the second portion 34 of the first bottom flap 28 and the adjacent end of the third slot 88 measured along the fifth fold line 40. The second slot 86 in the second end wall 18 is spaced from the fourth fold line 38 at the juncture of the second end wall 18 to the second portion 34 of the second bottom flap 30 by a distance less than the length of the third slot 88 in the second portion 34 of the second bottom flap 30, and the length of the second slot 86 in the second end wall 18 is greater than the distance between the free edge of the second portion 34 of the second bottom flap 30 and the adjacent end of the third slot 88 measured along the fifth fold line 40. The first slots 84, second slots 86, and third slots 88 provide for folding the container 10 into a thin stack 82. When the container 10 is folded to a collapsed condition as described above, the section of the first lock flap 66 between the free edge of the first lock flap 66 and adjacent end of the hook receiving slot 78 is nested within the first slot 84 of the first end wall 16, and the section of the second lock flap 68 between the free edge of the second lock flap 68 and the adjacent end of the hook receiving slot 78 is nested within the first slot 84 of the second end wall 18. Also, when the container 10 is folded to a collapsed condition as described above, the section of the second portion 34 of the first bottom flap 28 between the free edge of the second portion 34 and the adjacent end of the third slot 88 is nested within the second slot 86 of the first end wall 16, and the section of the second portion 34 of the second bottom flap 30 between the free edge of the second portion 34 and the adjacent end of the third slot 88 is nested within the second slot 86 of the second end wall 18. Therefore, the first slots 84, second slots 86, and third slots 88 provide for a thinner stack 82 than is otherwise accomplished without these first, second, and third slots.

As the side walls 12, 14, end walls 16, 18, and bottom wall 20 are folded to form the stack 82 the bag 81 also collapses because of its flexibility to be positioned inside the stack 82. Likewise, when the side walls 12, 14, end walls 16, 18, and bottom wall 20 are unfolded to form the container 10 the bag 81 also unfolds because it is attached to, for example the side walls, to an expanded or unfolded position inside the container 10.

Figure 14:
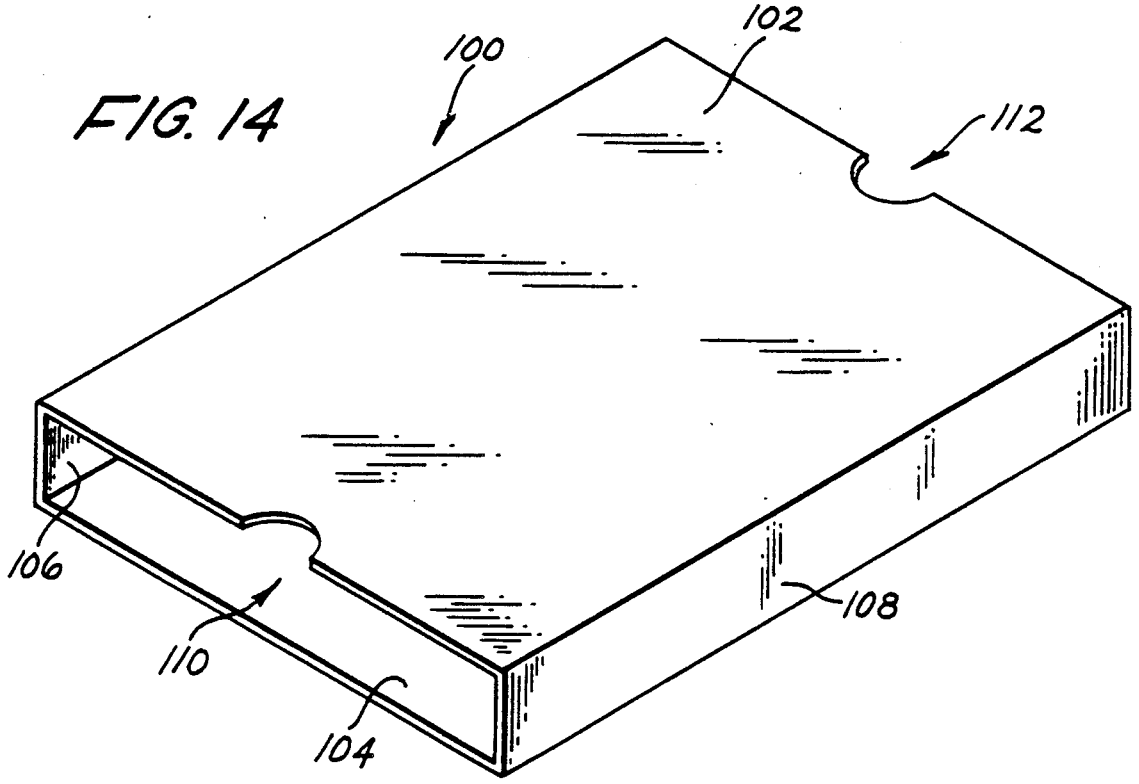

Now with reference to FIG. 14, there is shown an enclosure 100 for receiving the collapsed container 10. The enclosure 100 is a sleeve having top and bottom walls 102 and 104, respectively, and side walls 106 and 108. The opposite ends 110 and 112 of the sleeve enclosure 100 are open so that the collapsed container 10 can be inserted into and removed from the interior of the sleeve container 100. The sleeve container 100 is sized and configured to snuggly receive the collapsed container 10 therein to hold it in the collapsed configuration.

The foregoing detailed description is given primarily for clearness of understanding and no unnecessary limitiations are to be understood therefrom for modifications will become obvious to those skilled in the art upon reading this disclosure and may be made without departing from the spirit of the invention and scope of the appended claims.

I claim:

1. A collapsible container comprising:

first and second side walls;

first and second end walls joined at their opposite end edges to the end edges of the side walls, the junctures of the end walls and the side walls defining first fold lines about which the end walls are foldable relative to the end walls into an overlaying relationship to the inside surface of the side walls;

a second fold lilne formed in the first end wall midway between and parallel to the first fold lines and extending from the top edge to the bottom edge of the first end wall about which the sections of the first end wall divided by the second fold line are foldable back over each other as the first end wall folds about the first fold lines such that one section of the first end wall overlays the interior surface of the first side wall and the other section of the first end wall overlays the interior surface of the second side wall;

a second fold line formed in the second end wall midway between and parallel to the first fold lines and extending from the top edge to the bottom edge of the second wall about which the sections of the second end wall divided by the second fold line are foldable back over each other, as the second end wall folds about the first fold lines such that one section of the second end wall overlays the interior surface of the first side wall and the other section of the second end wall overlays the interior surface of the second side wall;

a bottom wall including first and second bottom flaps which are physically congruous and cooperate to form the bottom wall, the first bottom flap having a first portion joined to the bottom edge of the first side wall and a second portion joined to the bottom edge of the first end wall wherein the juncture of the first portion and first side wall defines a third fold line about which the first portion is foldable relative to the first side wall into an overlaying relationship to the inside surface of the first side wall and the juncture of the second portion and first end wall defines a fourth fold line about which the second portion is foldable relative to the first end wall into overlaying relationship to the inside surface of the first end wall, and the second bottom flap having a first portion joined to the bottom edge of the second side wall and a second portion joined to the bottom edge of the second end wall wherein the juncture of the first portion and second side wall define a third fold line about which the first portion is foldable relative to the second side wall into an overlaying relationship to the inside surface of the second side wall and the juncture of the second portion and second end wall defines a fourth fold line about which the second portion is foldable relative to the second end wall into overlaying relationship to the inside surface of the second end wall;

a fifth fold line formed in the second portion of the first bottom flap in alignment with the second fold line of the first end wall about which the sections of the second portion of the first bottom flap divided by the fifth fold line are foldable back over each other as the second portion of the first bottom flap folds about the fourth fold line such that one section of the second portion overlays one section of the first end wall and the other section of the second portion overlays the other section of the first end wall;

a fifth fold line formed in the second portion of the second bottom flap in alignment with the second fold line of the second end wall about which the sections of the second portion of the second bottom flap divided by the fifth fold line are foldable back over each other as the second portion of the second bottom flap folds about the fourth fold line such that one section of the second portion overlays one section of the second end wall and the other section of the second portion overlays the other section of the second end wall;

a sixth fold line formed in the first bottom flap dividing the first portion from the second portion extending from the juncture of the first side wall and first end wall to the distal end of the fifth fold line formed in the second portion about which the first and second portions of the first bottom flap are foldable back over each other as the first portion is folded about the third fold line and the second portion is folded about the fourth fold line;

a sixth fold line formed in the second bottom flap dividing the first portion from the second portion extending from the juncture of the second side wall and second end wall to the distal end of the fifth fold line formed in the second portion about which the first and second portions of the second bottom flap are foldable back over each other as the first portion is folded about the third fold line and the second portion is folded about the fourth fold line;

interlocking means associated with the first and second bottom flaps which releasably interlock the first and second bottom flaps extend across the bottom of the container forming the bottom wall;

a top wall including first and second top flaps which cooperate to form the top wall, the first top flap being joined to the top edge of the first side wall wherein the juncture defines a seventh fold line about which the first top flap is foldable relative to the first side wall into an overlaying relationship to the exterior surface of the first side wall, and the second top flap being joined to the top edge of the second side wall wherein the juncture defines a seventh fold line about which the second top flap is foldable relative to the second side wall into an overlaying relationship to the exterior surface of the second side wall;

a handle associated with the top wall including a first handle flap joined to the distal edge of the first top flap and a second handle flap joined to the distal edge of the second top flap and which cooperate in registered overlaying relationship to form the handle;

a first lock flap joined to the top edge of the first end wall and a second lock flap joined to the top edge of the second side wall and which first and second lock flaps overlay portions of the first and second top flaps and cooperate with the first and second handle flap to lock the first and second top flaps in position forming the top wall closing the open top of the container;

a tenth fold line formed in the first locking flap in alignment with the second fold line formed in the first end wall about which the sections of the first lock flap divided by the tenth fold line are foldable back over each other as the sections of the first end wall fold over each other about the second fold line such that one of the sections of the first lock flap overlays one of the sections of the first end wall and the other section of the first lock flap overlays the other section of the first end wall; and a tenth fold line formed in the second locking flap in alignment with the second fold line formed in the second end wall about which the sections of the second lock flap divided by the tenth fold line are foldable back over each other as the sections of the second end wall fold over each other about the second fold line such that one of the sections of the second lock flap overlays one of the sections of the second end wall and the other section of the second lock flap overlays the other section of the second end wall.

2. The collapsible container of claim 1, wherein the interlocking means comprises a notch formed in the distal edge of the first portion of the first bottom flap, and a notch formed in the distal edge of the first portion of the second bottom flap, the notches interengage to releasable interlock the distal ends of the first portions of the first and second bottom flaps together.

3. The collapsible container of claim 1, wherein:

the juncture of the first handle flap to the distal edge of the first top flap defines an eighth fold line parallel to the top edge of the first side wall about which the first handle flap is foldable relative to the first top flap into an overlaying relationship to the interior surface of the first top flap; and, the juncture of the second handle flap to the distal edge of the second top flap defines an eighth fold line parallel to the top edge of the second side wall about which the second handle flap is foldable relative to the second top flap into an overlaying relationship to the interior surface of the second top flap.

4. The collapsible container of claim 1, further comprising interlocking means associated with the first and second lock flaps and the first and second handle flaps which releasably interlock the first and second lock flaps to the first and second handle flaps thereby holding the first and second top flaps in a closed position forming the top wall.

5. The collapsible container of claim 1, wherein:

the juncture of the first lock flap to the top edge of the first end wall defines a ninth fold line about which the first lock flap is foldable relative to the first end wall to overlay the exterior surface of the first end wall; and, the juncture of the second lock flap to the top edge of the second end wall defines a ninth fold line about which the second lock flap is foldable relative to the second end wall to overlay the exterior surface of the second end wall.

6. The collapsible container of claim 1, further comprising a flexible, moisture impermeable enclosed by the side walls, end walls, bottom wall, and top wall with the opening of the bag coinciding with the open top defined by the top edges of the side walls and end walls.

7. The collapsible container of claim 6, wherein the bag is secured to at least two of the container walls.

8. The collapsible container of claim 6, wherein the bag is secured to the side walls by an adhesive.

9. The collapsible container of claim 6, wherein the bag is secured to the end walls.

10. The collapsible container of claim 9, wherein the bag is secured to the end walls at the location of the second fold lines.

* * * * *